US008757718B1

(12) United States Patent
Wloczewski

(10) Patent No.: US 8,757,718 B1
(45) Date of Patent: Jun. 24, 2014

(54) PORTABLE SEATING APPARATUS

(76) Inventor: James F. Wloczewski, Joppa, MD (US)

( * ) Notice: Subject to any disclaimer, the term of this patent is extended or adjusted under 35 U.S.C. 154(b) by 0 days.

(21) Appl. No.: 13/487,117

(22) Filed: Jun. 1, 2012

Related U.S. Application Data

(63) Continuation-in-part of application No. 12/827,263, filed on Jun. 30, 2010, now abandoned.

(60) Provisional application No. 61/221,685, filed on Jun. 30, 2009.

(51) Int. Cl.
*A47C 3/04* (2006.01)
*A47K 3/022* (2006.01)

(52) U.S. Cl.
USPC ..... 297/239; 4/578.1

(58) Field of Classification Search
USPC ..... 297/239, 440.1, 445.1, 452.22, 451.11, 297/45.13; 4/578.1, 571.1, 572.1
See application file for complete search history.

(56) References Cited

U.S. PATENT DOCUMENTS

| | | | | |
|---|---|---|---|---|
| 561,857 | A * | 6/1896 | Baxter | 248/439 |
| 2,399,960 | A | 5/1946 | Turner | 248/156 |
| 2,586,724 | A | 2/1952 | Sannebeck | 108/138 |
| 3,217,668 | A | 11/1965 | Hopper | 108/25 |
| 3,290,090 | A | 12/1966 | Ford | 297/118 |
| 3,719,389 | A | 3/1973 | Burton et al. | 297/440.24 |
| 4,032,097 | A * | 6/1977 | Dwyer | 248/146 |
| 4,064,993 | A * | 12/1977 | Getner | 211/85 |
| D263,109 | S * | 2/1982 | Peterson | D34/6 |
| 4,562,983 | A * | 1/1986 | Klefbeck | 248/97 |
| D289,577 | S * | 4/1987 | Graham | D34/5 |
| 5,230,105 | A * | 7/1993 | Watson | 4/460 |
| 5,307,527 | A | 5/1994 | Schober | |
| 5,441,433 | A | 8/1995 | Stanley | |
| 5,876,091 | A * | 3/1999 | Chernomashentsev | 297/16.2 |
| 5,903,935 | A | 5/1999 | Huelke | 4/560.1 |
| 6,000,068 | A * | 12/1999 | Chavis | 4/244.3 |
| 6,702,391 | B1 * | 3/2004 | Stipek | 297/452.65 |
| 7,293,840 | B1 * | 11/2007 | Schu | 297/451.13 |
| 2002/0153754 | A1 * | 10/2002 | Huang | 297/239 |
| 2008/0093896 | A1 * | 4/2008 | Zhang | 297/118 |
| 2010/0019558 | A1 | 1/2010 | Scheurer | |

FOREIGN PATENT DOCUMENTS

| | | | |
|---|---|---|---|
| CN | 202287178 U | * | 7/2012 |
| FR | 2661813 A1 | * | 11/1991 |

* cited by examiner

*Primary Examiner* — Milton Nelson, Jr.
(74) *Attorney, Agent, or Firm* — L.C. Begin & Associates, PLLC.

(57) ABSTRACT

A portable submersible seating apparatus is provided, including a support member and a plurality of leg members extending equidistantly from the support member. The plurality of the leg members are adapted to be rested on a floor of a swimming pool, thereby allowing a user to sit on the support member.

9 Claims, 5 Drawing Sheets

PORTABLE SEATING APPARATUS

CROSS-REFERENCE TO RELATED APPLICATIONS

This application is a continuation-in-part of U.S. application Ser. No. 12/827,263, filed on Jun. 30, 2010 now abandoned, which claims the benefit of U.S. Provisional Application No. 61/221,685 filed on Jun. 30, 2009. These prior applications are incorporated herein by reference.

FIELD OF THE INVENTION

The present disclosure generally relates to seating apparatuses, and, more specifically, to a portable seating apparatus capable of being used in a swimming pool.

BACKGROUND OF THE INVENTION

Typically, swimming pools are used for swimming, diving and other water-based recreation. Apart from swimming, people also like to relax and enjoy sitting in the swimming pool, especially in a hot climate. Various seating arrangements are available for use in the swimming pool. Such seating arrangements are usually aligned on wall of the swimming pool. However, such seating arrangements restrict movement of a user to a particular place. Also, various floatable seating arrangements are available which allow the user to float on the water of the swimming pool. However, such floatable seating arrangements are uncomfortable because of their bobbing movement in the water. Also, while using such floatable seating arrangements the user has to remain vigil and maintain the balance to remain seated on the floatable seating arrangement which may cause inconvenience to the user.

SUMMARY OF THE INVENTION

One embodiment of a portable submersible seating apparatus may include a support member and a plurality of leg members extending equidistantly from the support member, wherein the plurality of the leg members are adapted to be rested on a floor of a swimming pool, thereby allowing a user to sit on the support member.

BRIEF DESCRIPTION OF THE DRAWINGS

The advantages and features of the present disclosure will become better understood with reference to the following detailed description and claims taken in conjunction with the accompanying drawings, in which:

Like reference numerals refer to like parts throughout the description of the drawings.

DETAILED DESCRIPTION OF THE INVENTION

The exemplary embodiments described herein detail for illustrative purposes are subject to many variations in structure and design. It should be emphasized, however, that the present disclosure is not limited to a particular portable seating apparatus, as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "a" and "an" herein do not denote a limitation of quantity, but rather denote the presence of at least one of the referenced item. The use of terms "including," "comprising," or "having" and variations thereof herein is meant to encompass the items listed thereafter and equivalents thereof as well as additional items.

The present disclosure provides a portable seating apparatus for use in swimming pools. The portable seating apparatus may be also utilized in spas and other recreational places.

Figure 1:
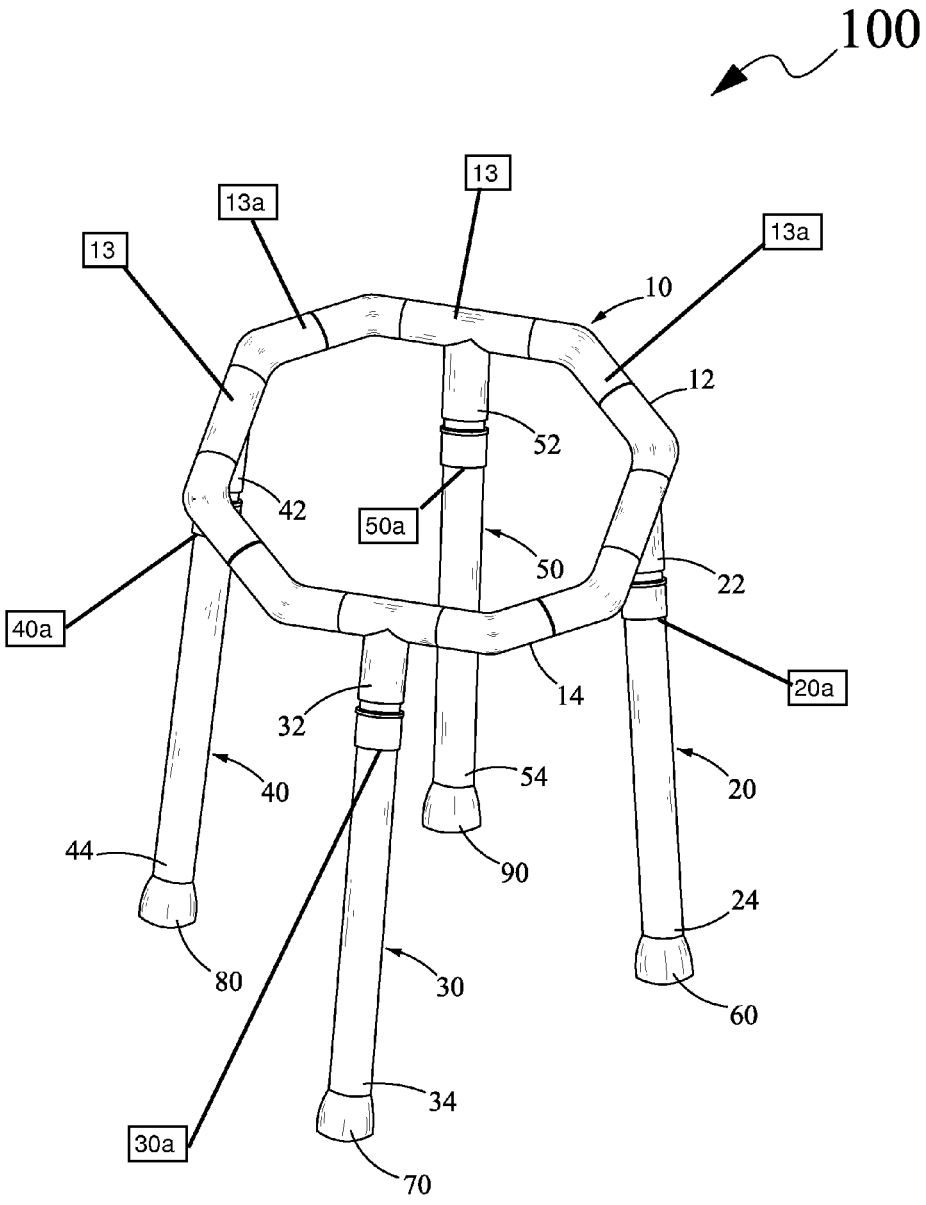
FIG. 1 is a perspective view of one embodiment of a portable seating apparatus in accordance with one embodiment of the present invention.

Referring to FIG. 1, one embodiment of a portable seating apparatus 100 may include a support member 10. Embodiments of the seating apparatus described herein are least partially submersible, to enable the seating apparatus to be immersed in water and to support a user seated thereupon while the apparatus is in the water. In the present embodiment, the support member 10 may be configured to have an octagonal shape. Alternatively, the support member 10 may be configured to have a circular, an oval or other polygonal shape. Further, in the present embodiment, the support member 10 may have a tubular cross-section. Alternatively, the support member 10 may be configured to have an oval or a polygonal cross-section. The support member 10 may include a plurality of straight side portions 13 interconnected at ends thereof. The support member 10 may also include a plurality of connecting portions 13*a*, each connecting portion 13*a* being attached to each side portion 13 of an associated pair of adjacent side portions to connect the adjacent side portions. Upper and lower surfaces of the interconnected side portions 13 and connecting portions 13*a* combine to define may include an upper portion 12 and a lower portion 14 of the support member 10, with the lower portion 14 residing opposite to the upper portion 12.

In a particular embodiment, the connecting portions 13*a* of the plurality of connecting portions are straight. However, the connecting portions 13*a* may be arcuate or may have any other shape suitable for the purposes described herein The portable seating apparatus 100 may also include a plurality of leg members such as, leg members 20, 30, 40, and 50. It is to be understood that, the number of leg members (four leg members) should not be considered as limitation to the present disclosure. For example, the portable seating apparatus 100 may include at least thee leg member or more than four leg members. Although not necessary, the leg members 20, 30, 40, 50 may extend equidistantly (i.e., each leg member extends an equal distance from the support member 10) from the support member 10, thereby providing enhanced and uniform support. Specifically, the leg members 20, 30, 40, 50 may extend equidistantly from the lower portion 14 of the support member 10.

Figure 6:
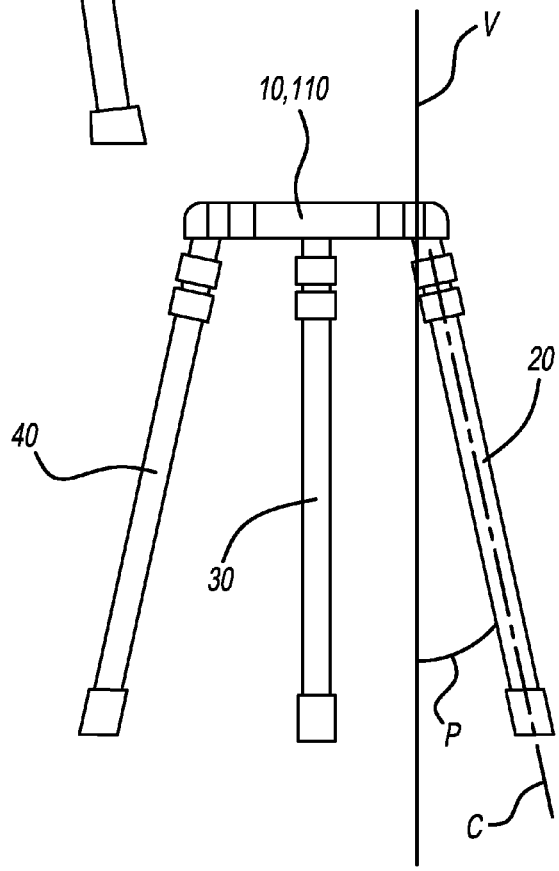
FIG. 6 is a side view of a seating apparatus in accordance with an embodiment of the present invention showing an angular orientation of the leg members.

In the embodiments described herein, leg members 20, 30, 40, and 50 may splay outwardly from the support member as extend from the support member, so as to increase the breadth and stability of the support base formed by contact between the bottom end portions of the leg members. Each of leg members 20, 30, 40, and 50 thus forms an angle P with a vertical axis V passing through the support member at portion of the support member to which the respective leg member is attached, as seen in FIG. 6.

Figure 2:
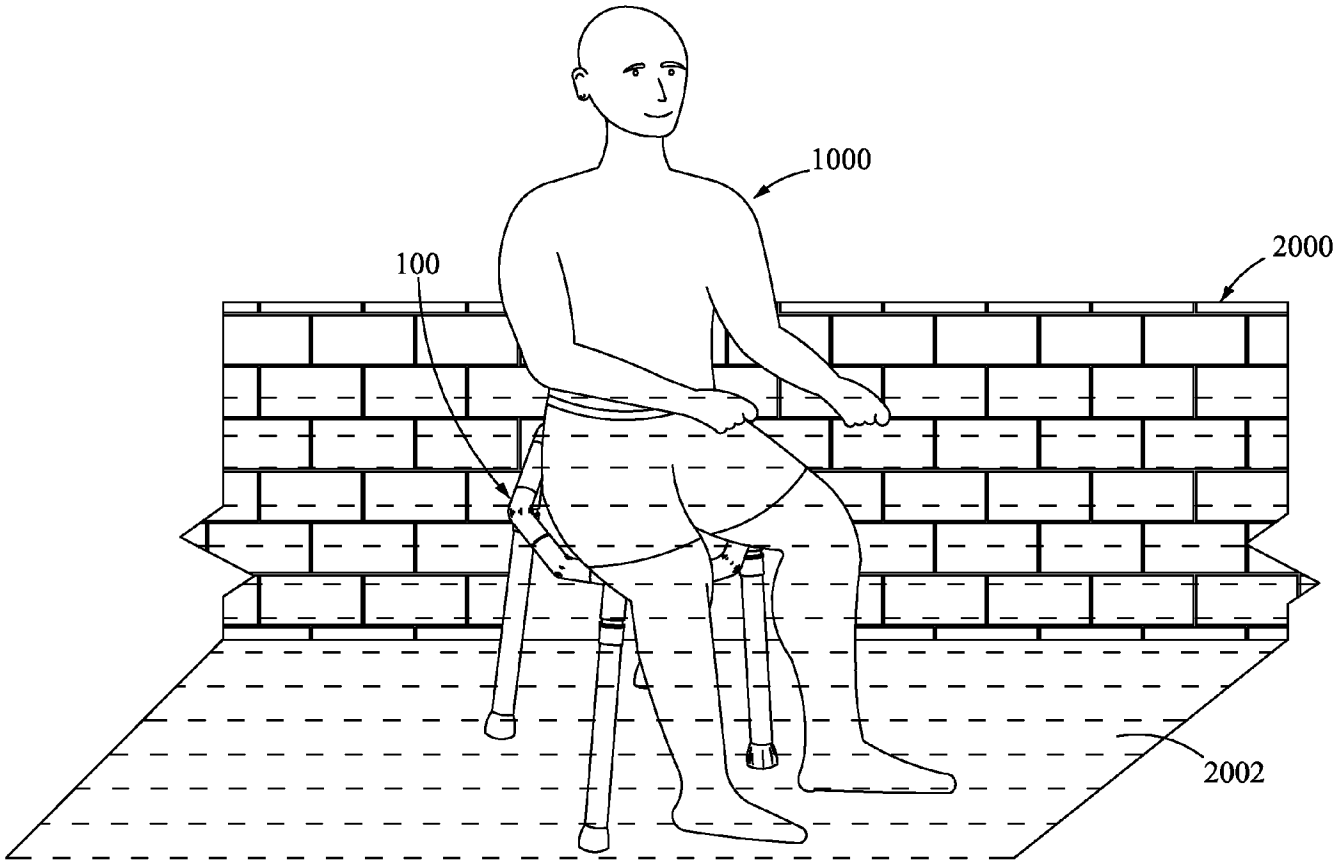
FIG. 2 is an environment in which the portable seating apparatus of FIG. 1 may be utilized for sitting in a swimming pool.
Figure 3:
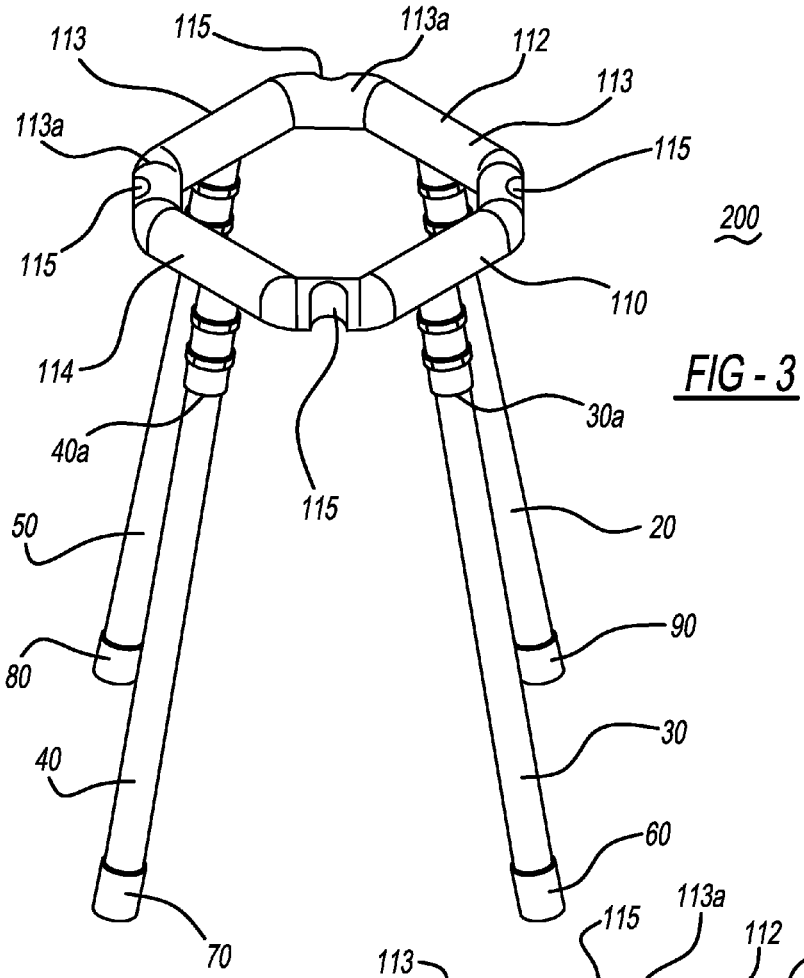
FIG. 3 is a perspective view of a portable seating apparatus in accordance with another embodiment of the present invention.
Figure 4:
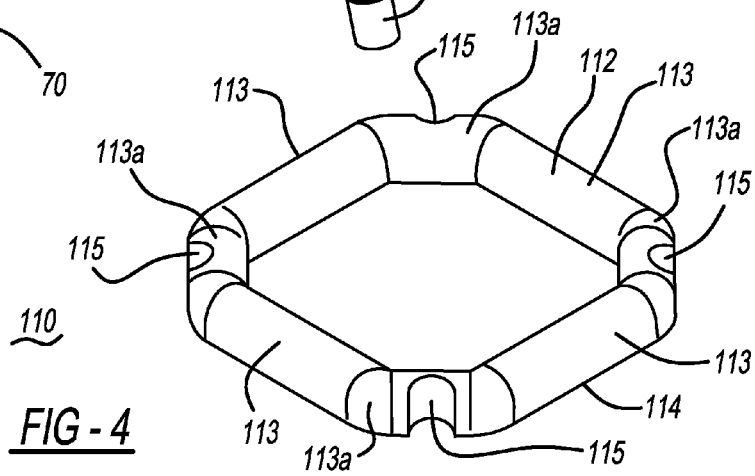
FIG. 4 is a perspective view of a support member incorporated into the embodiment shown in FIG. 3.

In the embodiments shown in FIGS. 1 and 2, each of leg members 20, 30, 40, 50 extends from a side portion 13 of the plurality of side portions. In alternative embodiments, each of leg members 20, 30, 40, 50 extends from a connecting portion 13*a* of the plurality of connecting portions.

The each of leg members 20, 30, 40, 50 may include a top end portion and a bottom end portion. As shown in FIG. 1, the leg members 20, 30, 40, 50 may include top end portions 22, 32, 42, 52, respectively. Further, the leg members 20, 30, 40, 50 may also include bottom end portions 24, 34, 44, 54, respectively, opposite to the top end portions 22, 32, 42, 52. Furthermore, each of the leg members 20, 30, 40, 50 may include gripping members 60, 70, 80 and 90, respectively. More specifically, the gripping members 60, 70, 80, 90 may be removably attached with the bottom end portions 24, 34, 44, 54, respectively, of the leg members 20, 30, 40, 50.

The support member 10 and the leg members 20, 30, 40, 50 may be made of a material having sufficient rigidity such that the portable seating apparatus 100 may be capable of comfortably bearing a weight of user. Further, the support member 10 and the leg members 20, 30, 40, 50 may be made of a lightweight, a non-corrosive, and a floatable material. A suitable example of such material may include, but is not limited to, thermoplastic polymer such as Polyvinyl chloride (PVC). It is to be understood that the material of the support member 10 and the leg members 20, 30, 40, 50 should not be considered as a limitation to the present disclosure. Furthermore, the gripping members 60, 70, 80, 90 of the portable seating apparatus 100 may be made of a lightweight and durable material, which may include but not limited to rubber material.

In the present embodiment, the support member 10 and the leg members 20, 30, 40, 50 may be configured to be separate components, which may be capable of removably engaging with each other for configuring the portable seating apparatus 100. Alternatively, the portable seating apparatus 100 may be configured to be a single unitary structure. Further, the portable seating apparatus 100 may be manufactured by using a suitable manufacturing method, such as machining, casting, and molding, or any other suitable method. It is to be understood that the manufacturing method of the portable seating apparatus 100 should not be considered as a limitation to the present disclosure.

Referring now to FIG. 2, in use, a user 1000 may place the portable seating apparatus 100 in a swimming pool 2000. Once the portable seating apparatus 100 is placed in the swimming pool 2000, the portable seating apparatus 100 may tend to float on the water of the swimming pool 2000. The user 1000 may thereafter utilize the portable seating apparatus 100 for sitting purpose, when the leg members 20, 30, 40, 50 may be brought in contact with a floor 2002 of the swimming pool 2000. This allows the user 1000 to utilize the upper portion 12 (shown in FIG. 1) of the support member 10 for sitting purpose. Accordingly, the portable seating apparatus 100 may remain stationary when in use, thereby allowing the user 1000 to be seated with ease and comfort in the swimming pool 2000.

Further, the gripping members 60, 70, 80, 90 may provide grip on the floor 2002 of the swimming pool 2000. Specifically, the gripping members 60, 70, 80, 90 may provide grip between the floor 2002 and the leg members 20, 30, 40, 50 of the portable seating apparatus 100. This may prevent the portable seating apparatus 100 from slipping or getting imbalanced on the floor 2002 of the swimming pool 2000, when the user 1000 may be sitting on the portable seating apparatus 100. Also, the gripping members 60, 70, 80, 90 may prevent damage to the floor 2002 of the swimming pool 2000 which may be caused by the bare bottom end portions 24, 34, 44, 54 of the leg members 20, 30, 40, 50.

Referring to FIGS. 3-6, a portable seating apparatus 200 in accordance with another embodiment of the present invention includes a support member 110 having an upper portion 112 and a lower portion 114, similar to upper portion 12 and lower portion 14 of support member 10.

Support member 110 also includes a plurality of straight side portions 113 interconnected at ends thereof. The support member 110 may also include a plurality of connecting portions 113*a*, each connecting portion 113*a* being attached to each side portion 113 of an associated pair of adjacent side portions to connect the adjacent side portions. Upper and lower surfaces of the interconnected side portions 113 and connecting portions 13*a* combine to define upper and lower portions 112 and 114, respectively, of the support member 110, with the lower portion 114 residing opposite to the upper portion 112. Apparatus 200 also includes leg members 20, 30, 40, 50 and gripping members 60, 70, 80 and 90 as previously described.

In the embodiment shown in FIGS. 3-6, the support member 110 includes a plurality of cavities 115 formed therealong, each cavity 115 of the plurality of cavities being positioned to align with, and being sized to receive therein, a portion of one of leg members leg members 20, 30, 40, 50 of a second portable submersible seating apparatus when the other seating apparatus is stacked upon the first seating apparatus.

Figure 5:
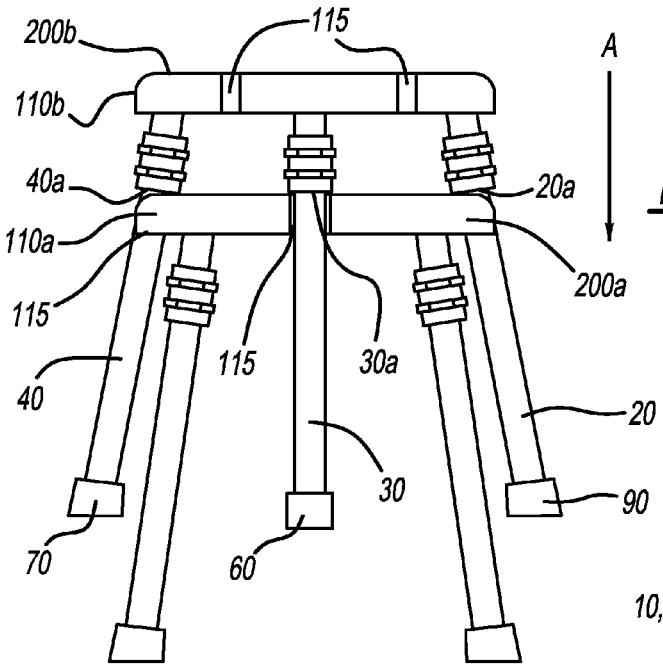
FIG. 5 is a side view of a pair of seating apparatuses in configured as shown in FIGS. 3 and 4, in a stacked condition.

Stacking of first and second similarly configured seating apparatuses 200*a* and 200*b* is shown in FIG. 5. To facilitate stacking of the portable seating apparatuses, one or more leg members 20, 30, 40, 50 may have a shoulder formed therealong. In the embodiments shown in FIGS. 1 and 3, each of leg members 20, 30, 40, 50 has an associated shoulder 20*a*, 30*a*, 40*a*, 50*a*, respectively, formed therealong. Each of shoulders 20*a*, 30*a*, 40*a*, 50*a* is dimensioned to abut an edge of an associated one of cavities 115 or another portion of a support member of another seating apparatus when the seating apparatus incorporating the leg members 20, 30, 40, 50 is stacked upon the other seating apparatus. Contact between the shoulder(s) of one seating apparatus and the support member of the other seating apparatus serves to provide a hard stop, enabling control of the relative positions of the seating apparatuses when stacked. This enables a desired, consistent and repeatable stacking position of one seating apparatus on another to be achieved.

When stacking seating apparatus 200*b* on apparatus 200*a*, each of leg members 20, 30, 40, 50 of apparatus 200*b* is aligned with a corresponding one of cavities 115 formed in support member 110*a* of seating apparatus 200*a*. Support member 110*b* of seating apparatus 200*b* is then moved in direction "A", closer and closer into proximity with support member 110*a* of seating apparatus 200*a*, until shoulders 20*a*, 30*a*, 40*a*, 50*a* formed along leg members 20, 30, 40, 50 of apparatus 200*b* abut support member 110*a*, whereupon further motion of support member 110*b* in direction "A" is prevented.

The locations and orientations of leg members 20, 30, 40, 50 may be specified with respect to the locations, sizes, and shapes of the cavities 115 such that one or more interference fits may be formed between portions of seating apparatus 200*a* and portions of seating apparatus 200*b* are when the seating apparatuses are stacked, thereby aiding in retaining the seating apparatuses in a stacked condition. This procedure may be followed with additional seating apparatuses to enable any desired number of seating apparatuses to be stacked. Thus, in a configuration where the leg members of each seating apparatus are equi-angularly disposed (i.e., attached to the support member at equal intervals along the support member), the leg members of any pair of stacked seating apparatuses 200*a* and 200*b* are angularly spaced apart 360°/(2×L) degrees, where L=the total number of leg members of the two seating apparatuses. Thus, in the example shown in FIG. 6, with each seating apparatus incorporating four equally spaced leg members, a leg member will extend from the stack every 45°.

Figure 7:
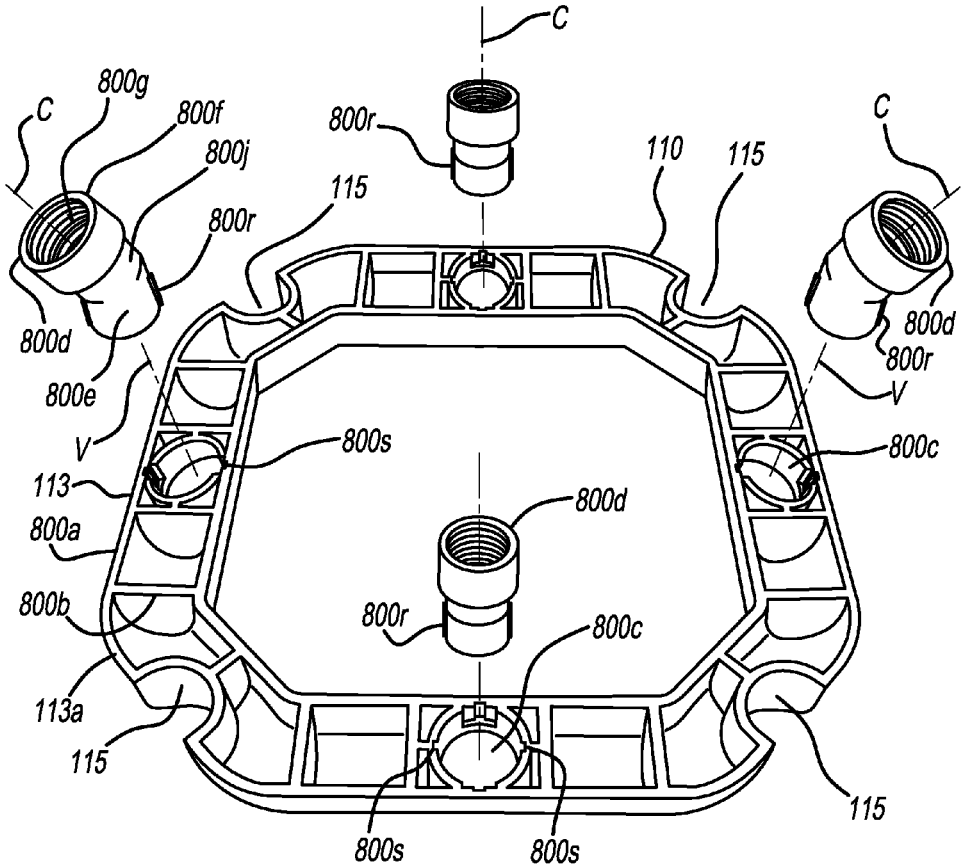
FIG. 7 is a perspective view of a structure of one embodiment of the support member shown in FIGS. 3-6.

FIG. 7 shows a structure for one embodiment of the support member 110 shown in FIGS. 3-6. Features of this structure may also be incorporated into support member 10 shown in the embodiment of FIGS. 1 and 2.

Support member 110 includes an outer wall 800*a* and ribs 800*b* connecting portions of wall 800*a* to enhance the strength and rigidity of the support member. In addition, cavities 800*c* are formed between portions of the support member wall 800 for receiving and securing mounting braces 800*d* therein. Each cavity 800*c* has a plurality of slots 800*s* spaced apart along walls of the cavity.

Each mounting brace 800*d* has a base portion 800*e*, a receptacle portion 800*f*, and a juncture portion 800*j* connecting base portion 800*e* with receptacle portion 800*f*.

Base portion 800*e* has a plurality of ribs 800*r* formed along an exterior surface of the base portion and spaced apart such that each rib 800*r* aligns with an associated one of slots 800*s* formed along the walls of one of cavities 800*c*. This enables alignment of the mounting braces in the manner described below. In the embodiment shown in FIG. 7, each base portion 800*e* is inserted into an associated cavity 800*c* along an associated vertical axis V.

Receptacle portion 800*f* defines a cavity 800*g* structured for receiving and securing an end portion of an associated one of leg members 20, 30, 40, and 50 therein. The leg member is received into an associated cavity along an axis C extending through the cavity center. In the embodiment shown, walls of the receptacle portion cavity are threaded and end portions of leg members 20, 30, 40, and 50 are complementarily threaded so that the leg members can be screwed into the receptacle portion cavities. Other methods of attaching the leg members to the mounting braces are also contemplated.

Juncture portion 800*j* is structured to connect base portion 800*e* with receptacle portion 800*f* such that, when the base portion is secured to support member 110 and one of the leg members is secured in the receptacle portion, the leg member extends in a direction outwardly from the vertical axis V and the support member 110, along an axis C forming an angle P with vertical axis V, as shown in FIG. 6. To aid in achieving the desired orientation of the receptacle axis C, slots 800*s* may be positioned along cavities 800*c* and ribs 800*r* positioned along receptacle portion 800*f* such that the ribs 800*r* may be inserted into the slots 800*s* only when the desired outward orientation of the receptacle axis C has been achieved.

The support member and mounting brace embodiment shown in FIG. 7 may be formed by molding, casting, or any other suitable means.

Based on the forgoing description, a portable seating apparatus, such as the portable seating apparatus 100, may provide a simple and comfortable seating arrangement adapted to be used in a swimming pool. Due to the simple structural configuration and the lightweight material of construction, the portable seating apparatus is capable of being used by people of all age groups with ease and comfort. Further, the portable seating apparatus may be made of multitude of sizes and colors. Also, the portable seating apparatus may be capable of being used outside the swimming pool.

The foregoing descriptions of specific embodiments of the present disclosure have been presented for purposes of illustration and description. They are not intended to be exhaustive or to limit the disclosure to the precise forms disclosed, and obviously many modifications and variations are possible in light of the above teaching. The embodiments were chosen and described in order to best explain the principles of the disclosure and its practical application, and thereby enable others skilled in the art to best utilize the disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present disclosure.

What is claimed is:

1. A portable submersible seating apparatus comprising:

an annular support member, and a plurality of leg members extending equidistantly from the annular support member wherein said support member is attached only to said plurality of leg members, wherein the plurality of the leg members are adapted to be rested on a floor of a swimming pool, thereby allowing a user to sit on the annular support member, and wherein the support member includes a plurality of cavities formed therealong, each cavity of the plurality of cavities being positioned to align with, and being sized to receive therein, a portion of one leg member of a plurality of leg members of another, similarly configured seating apparatus when the other seating apparatus is stacked upon the seating apparatus.

2. The seating apparatus of claim 1 wherein at least one leg member of the plurality of leg members has a shoulder formed therealong, the shoulder being structured for abutting a support member of another, similarly configured seating apparatus when the seating apparatus is stacked upon the other seating apparatus.

3. The seating apparatus of claim 1, wherein each leg member of the plurality of leg members comprises a removable gripping member for providing grip on the floor of the swimming pool.

4. The seating apparatus of claim 1 wherein said annular support member is circular, oval, or polygonal in shape.

5. The seating apparatus of claim 1 wherein the support member has a plurality of straight side portions interconnected at ends thereof.

6. The seating apparatus of claim 5 wherein each leg member extends from a side portion of the plurality of side portions.

7. The seating apparatus of claim 5 wherein the support member further comprises a plurality of connecting portions, each connecting portion being attached to each side portion of an associated pair of adjacent side portions to connect the adjacent side portions.

8. The seating apparatus of claim 7 wherein the connecting portions of the plurality of connecting portions are straight.

9. The seating apparatus of claim 7 wherein each leg member extends from a connecting portion of the plurality of connecting portions.

* * * * *

UNITED STATES PATENT AND TRADEMARK OFFICE

CERTIFICATE OF CORRECTION

PATENT NO. : 8,757,718 B1
APPLICATION NO. : 13/487117
DATED : June 24, 2014
INVENTOR(S) : Wloczewski It is certified that error appears in the above-identified patent and that said Letters Patent is hereby corrected as shown below:

In the Specification

Column 2; Line 53; Delete “thee” and insert --three--.

Column 6; Line 4; Delete “forgoing” and insert --foregoing--.

Signed and Sealed this
Ninth Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,757,718 B1
APPLICATION NO. : 13/487117
DATED : June 24, 2014
INVENTOR(S) : Wloczewski It is certified that error appears in the above-identified patent and that said Letters Patent is hereby corrected as shown below:

In the Specification

Column 2; Line 63; Delete “thee” and insert --three--.

Column 6; Line 4; Delete “forgoing” and insert --foregoing--.

This certificate supersedes the Certificate of Correction issued September 9, 2014.

Signed and Sealed this
Thirteenth Day of January, 2015

Michelle K. Lee

Michelle K. Lee
*Deputy Director of the United States Patent and Trademark Office*